United States Patent [19]

Bonazoli et al.

[11] Patent Number: 4,587,454

[45] Date of Patent: May 6, 1986

[54] INCANDESCENT LAMP WITH IMPROVED PRESS SEAL

[75] Inventors: Robert P. Bonazoli, South Hamilton, Mass.; Owtis J. Ragland, Jr., Winchester, Ky.

[73] Assignee: GTE Products Corporation, Stamford, Conn.

[21] Appl. No.: 611,553

[22] Filed: May 17, 1984

[51] Int. Cl.[4] ..... H01J 5/50

[52] U.S. Cl. ..... 313/331; 174/50.64; 313/332

[58] Field of Search ..... 313/331, 332; 174/152 GM, 50.64

[56] References Cited

U.S. PATENT DOCUMENTS

| | | | |
|---|---|---|---|
| 2,227,511 | 1/1941 | Reynold | 174/50.64 |
| 2,786,882 | 3/1957 | Krefft | 313/332 |
| 3,105,867 | 10/1963 | Meijer | 174/50.64 |

FOREIGN PATENT DOCUMENTS

| | | | |
|---|---|---|---|
| 780614 | 8/1957 | United Kingdom | 174/50.64 |

*Primary Examiner*—Harold Dixon

*Attorney, Agent, or Firm*—Lawrence R. Fraley

[57] ABSTRACT

An improved electric lamp including an envelope of high silica glass material having a press sealed end wherein there is embedded a thin molybdenum foil which in turn forms part of the lamp's lead-in wire assembly. Crack formation in the area of the interface between the foil's external longitudinal surfaces and the compressed glass material is substantially prevented by providing the longitudinal sides of the foil with rough surfaces to assure substantial adhesion between the glass material and foil when the press sealed end is subjected to elevated temperatures (e.g., during pressing and/or subsequent lamp operation). These rough surfaces are provided by exposing the longitudinal sides of the foil to a sandblasting operation.

9 Claims, 3 Drawing Figures

INCANDESCENT LAMP WITH IMPROVED PRESS SEAL

TECHNICAL FIELD

The invention relates to electric incandescent lamps and particularly to incandescent lamps of the tungsten halogen variety. Even more particularly, the invention relates to such lamps wherein a press seal end is utilized.

BACKGROUND

Tungsten halogen lamps possessing the aforementioned press seal end are known in the art. Examples include:

| | |
|---|---|
| 3,548,245 | Biscoff |
| 3,588,315 | Levand, Jr. et al |
| 3,668,456 | Anderson |
| 3,753,026 | Goorissen |
| 4,110,657 | Sobieski |
| 4,254,300 | Thompson-Russell |
| RE 31,519 | Sobieski |

As indicated in the aformentioned patents, it is known in tungsten halogen lamps to utilized a thin molybdenum foil (or ribbon) of substantially rectangular configuration within the press seal end of the lamp's envelope. Typically, this thin foil member is connected (e.g., welded) to a pair of electrically conducting wires to thus form one of the lead-in wire assemblies for the lamp's filament. Understandably, should a singular filament be utilized, two such assemblies are employed. One of these conducting wires (that being connected to or forming part of the filament component) is typically of tungsten material and extends interiorly of the high silica glass envelope of the lamp. The remaining, second conducting wire may be of molybdenum or similar conducting material and extends exteriorly of the envelope.

Understandably, formation of an effective seal about the molybdenum foil and corresponding end portions of the respective conducting wires is extremely important. Should cracks or similar imperfections occur in the area of the foil members, the seal can be broken, resulting in ruination of the lamp product. Crack formation (or at least initial formation followed by subsequent expansion during lamp operation) typically occurs during or shortly after the pressing operation to form the sealed end. During this pressing operation, the glass material is heated to extremely high temperatures (e.g., using oxygen burners) in the vicinity of the eventual seal. Stainless steel pinch (or press) jaws engage the outer surfaces of this heated glass and compress said glass about the already formed conducting wire-molybdenum foil assembly. Typically, gaseous nitrogen is used at this phase of the operation to "cool" the conducting wire-molybdenum foiled assembly. Understandably, such an operation is deemed extremely harsh and can result in crack formation or the like as a result of the substantial difference in coefficients of thermal expansion of the materials utilized. For example, glass material having a silicon oxide content of at least ninety-five percent by weight as used in some lamps of this variety possesses a coefficient of thermal expansion of approximately $10\times10^{-7}$ per deg. Celsius as compared to the coefficient of thermal expansion of tungsten and molybdenum ($45\times10^{-7}$ and $54\times10^{-7}$ per deg. Celsius, respectively).

Crack formation is also readily possible during the subsequent phase of lamp formation wherein liquid nitrogen is introduced into the remaining, open end of the glass tubing which eventually forms the lamp envelope. This flushing operation occurs during the exhaust phase of lamp formation and exposes the heated press sealed end of the tubing to such relatively cold material. It is estimated that during the aforementioned press sealing operation, seal temperatures in excess of 1000° Celsius are attained.

It is thus believed that an electric lamp including a press seal end formed in such a manner so as to substantially prevent crack formation therein would constitute a significant advancement in the art.

DISCLOSURE OF THE INVENTION

It is, therefore, a primary object of the instant invention to enhance the electric lamp art.

It is another object of the instant invention to provide an electric lamp having an improved press seal end wherein crack formation is substantially prevented.

It is another object of the invention to provide such a lamp wherein the press seal end is formed in a facile and relatively inexpensive manner.

In accordance with one aspect of the invention, there is provided an improved electric lamp including an envelope comprised of a high silica glass material and having a press sealed end, a thin molybdenum foil having opposed longitudinal sides and entirely embedded within the press sealed end, a first conductor connected to the molybdenum foil and extending interiorly of the envelope, and a second conductor connected to the molybdenum foil and extending exteriorly of the envelope. The opposed longitudinal sides of the molybdenum foil are each provided with a rough surface for substantially adhering to the glass material of the press sealed end when this end is subjected to elevated temperatures (e.g., during press sealing and/or lamp operation).

BRIEF DESCRIPTION OF THE DRAWINGS

Both FIGS. 2 and 3 represent sectional end views as would be taken along a line (i.e., line x—x in FIG. 1) passing through a tungsten halogen lamp's press sealed end. Only one of the two foils (or more if added filaments are used) used in the end is illustrated.

BEST MODE FOR CARRYING OUT THE INVENTION

For a better understanding of the present invention, together with other and further objects, advantages and capabilities thereof, reference is made of the following disclosure and appended claims taken in conjunction with the above-described drawings.

Figure 1:
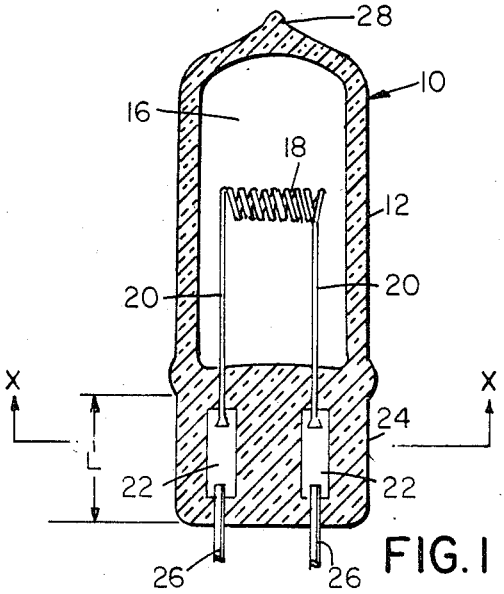
FIG. 1 is a front elevational view, in section, of an electric lamp having a press sealed end portion.

In FIG. 1, there is shown a tungsten halogen lamp 10 containing a glass envelope 12 defining a central cavity 16 in which is contained an inert gas fill along with a small amount of a suitable halogen (e.g., iodine or bromine) which functions as a regenerative getter. As is known, such a getter functions to return filament tungsten particles vaporized from the filament during lamp operation. Lamp 10 further includes the aforementioned tungsten filament 18 being connected at opposed ends thereof to two electrically conducting wires (conductors) 20 which provide both electrical connection and support for filament 18.

As illustrated, one end of envelope 12 is provided with a press seal 24 formed using a press sealing operation such as defined above. Located within press seal 24 is a pair of spaced-apart rectangularly shaped thin molybdenum foils 22 which function to interconnect the first conductors 20 with a respective pair of exteriorly projecting second wire conductors 26. Conductors 26 may be of molybdenum of similar material whereas the first conductors 20 may be of tungsten material (particularly true of course if these members represent extensions of the tungsten filament). At the opposing end of envelope 12 is a tip portion 28 which is formed to provide the final seal for envelope 12. Such a tipping operation is well known in the art and further description is not believed necessary.

It is understood that the lamp of FIG. 1 represents but one of several examples of electric lamps of the tungsten halogen variety capable of utilizing the teachings of the instant invention. The invention is thus not restricted, for example, to such lamps wherein a singular filament is employed. Examples of other lamps also capable of using the instant invention may be found in some of the several aforementioned patents.

Figure 2:
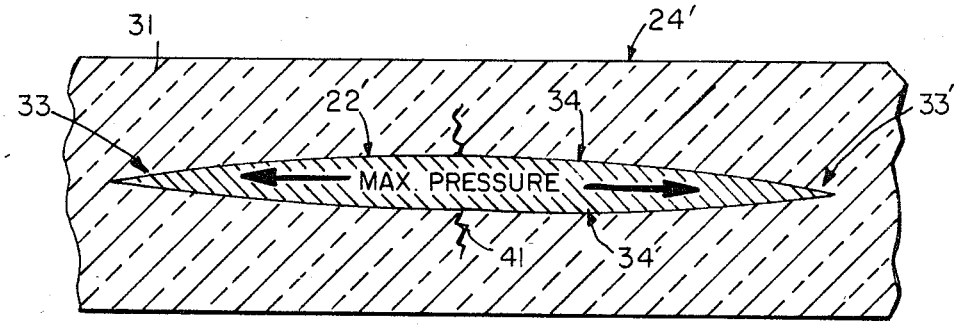
FIG. 2 is an enlarged end elevational view, in section, of a press sealed end portion of an electric lamp including a molybdenum foil having smooth external surfaces.

With particular attention to FIG. 2, there is illustrated a much enlarged end elevational view of a press sealed end of a tungsten halogen lamp using a tapered molybdenum foil 22' having opposite, smooth surfaces 34 and 34'. Such a view, as might be taken along a line (i.e., line x—x in FIG. 1) through the press seal, illustrates the molybdenum foil 22' entirely embedded within the sealed end's glass material 31. For purposes of illustration, this foil member is represented by the numeral 22', while the numeral 24' is utilized to represent the sealed end. As illustrated, foil 22' is of substantially longitudinal configuration and possesses substantially tapered end segments 33 and 33'. Accordingly, the foil includes the aforementioned opposed, smooth longitudinal surfaces 34 and 34' which eventually merge to form the defined sharpened or tapered end segments. It was observed in some lamps possessing molybdenum foils of this configuration that cracks occasionally resulted. Such cracks 41 usually occurred at the approximate center of the foil (as indicated) and were believed to occur during lamp formation as a result of the ability of the relatively smooth, opposed external longitudinal surfaces to move relative to the compressed glass material 31 at the location of interface between said material and said sides. That is, lack of adherence between the glass and opposed foil sides during the aforementioned expansion of these materials resulted in substantial longitudinal expansion in an opposed manner (as illustrated by the directional arrows in FIG. 2). Accordingly, relatively high forces were exerted in these opposed directions toward the molybdenum foil edges. Such uneven pressure distribution in turn created uneven stresses at the approximate center of the interface between foil and glass material, in turn occasionally resulting in crack formation (illustrated by crack 41). Should such cracks run from the internal conductor to the second, external conductor, internal lamp volume leakage will occur and the lamp product is rendered inoperative.

Figure 3:
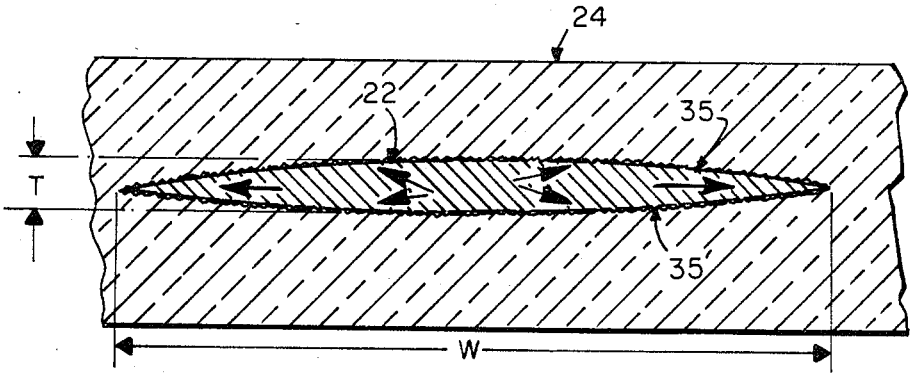
FIG. 3 is an enlarged end elevational view of a press sealed end of an electric lamp containing the molybdenum foil of the instant invention.

It has been found, surprisingly, that by providing each of the opposed longitudinal sides of the molybdenum foil with a relatively rough surface the aforementioned crack formation can be substantially prevented. Such rough surfaces are illustrated in the enlarged view of FIG. 3 wherein the rectangular-shaped foil member 22, embedded entirely within the press sealed end 24, contains said surfaces along the entirety of these longitudinal sides 35 and 35'. Such rough surfaces are preferably provided by exposing the longitudinal sides to a sandblasting operation during foil formation. During such formation, an elongated piece of cylindrical molybdenum wire is subjected to a series of compressive roller operations wherein the wire is subsequently compressed to a thin (e.g., 0.001 inch thick) foil member having a substantially rectangular configuration. In accordance with the teachings of the invention, sandblasting is utilized to the extent that approximately one-tenth of the foil's total thickness (T in FIG. 3) is penetrated. That is, the opposed longitudinal sides (upper and lower) of the rectangular-shaped (cross-section) wire are provided with such a surface. As a result, the expansion pressure forces of the molybdenum foil are much more evenly distributed than those illustrated in FIG. 2 for the smooth molybdenum foil. Such distribution of forces is represented by the several directional arrows provided in FIG. 3.

As stated, it was surprisingly found that providing the longitudinal sides of the molybdenum foils with roughened surfaces resulted in a substantial prevention of crack formation. More specifically, lamps possessing foils of the type illustrated in FIG. 2 possessed a failure rate approaching three percent. Comparatively, lamps possessing the described rough surfaces of the instant invention possessed a failure rate of less than about 0.4 percent. In accordance with a specific example of the instant invention, a glass envelope of fused silica was utilized and possessed an overall length of about 1.20 inches. The press seal end of the envelope possessed a total length (L in FIG. 1) of about 0.56 inch and an overall width of about 0.415 inch. The corresponding width (W in FIG. 3) of each of the two molybdenum foils was about 0.121 inch, with a spacing therebetween of about 0.035 inch. The externally projecting conductors 26 extended a distance of about 0.150 inch from the edge of the press seal end. Each foil, in turn, possessed an overall length of 0.354 inch. A CC8 (coiled-coil) tungsten filament was utilized and was supported by internal conductors also of tungsten material. The external (outer) conductors were of molybdenum. The lamp was operational at about 300 watts for a duration in excess of 35 hours.

In formation of the aforementioned molybdenum foil for use in the invention, the outer edge portions (those to the right and left in FIG. 3) were subjected to differential etching to provide the illustrated tapered edge segments. This etching (performed chemically) occurred, according to one technique for producing the invention, subsequent to the aforedefined sandblasting operation wherein the roughened surfaces were provided. This etching operation will not significantly adversely affect the rough surfaces provided by the described sandblasting operation. In one example of the invention, cylindrical molybdenum wire was passed several times (about twelve to twenty) through a plurality of sets of opposed rollers until the approximate thickness desired was reached. This flattened material may then be subjected to the aforementioned sandblasting operation. Subsequently, chemical etching using a solution of potassium nitrate and potassium hydroxide may be performed to provide the tapered end segments illustrated in FIG. 3. To assure such a taper, greater current densities should be applied along the edge portions of the flattened ribbon than at the center portion thereof. The desired rough texture will remain throughout the entire length of both opposed sides. In accordance with another example of a technique for producing the foil of the invention, the foil may be sandblasted after the aforementioned rolling and chemical etching procedures have occurred. This latter technique can even be done subsequent to securing (e.g., welding) of the outer conductor (e.g., molydenum wire) to one end of the tapered-edge foil member, thus facilitating handling of the foil during said technique.

There has thus been shown and described an improved electric lamp wherein the press seal end of the lamp includes at least one molybdenum foil element capable of substantially preventing crack formation in the area of the foil (about the external surfaces thereof). As explained, this valuable feature is attained using a procedure which is relatively inexpensive and can be implemented in a facile manner.

We claim:

1. In an electric lamp including an envelope comprised of a high silica glass material and having a press sealed end, a thin molybdenum foil having opposed longitudinal sides and entirely embedded within said press sealed end, a first conductor connected to said molybdenum foil and extending interiorly of said envelope, and a second conductor connected to said molybdenum foil and extending exteriorly of said envelope, the improvement wherein said foil is of substantially flat configuration and includes outwardly extending tapered end segments, each of said opposed longitudinal sides of said molybdenum foil possessing a rough surface for substantially adhering to said glass material of said press sealed end when said end is subjected to elevated temperatures, the expansion forces of said molybdenum foil having said tapered end segments and said rough surfaces within said longitudinal sides thereof being substantially evenly distributed within said molybdenum foil against said glass material during said elevated temperatures, thereby substantially preventing crack formation within said press sealed end about said molybdenum foil.

2. The improvement according to claim 1 wherein said rough surfaces of said opposed longitudinal sides of said molybdenum foil are formed by sandblasting.

3. The improvement according to claim 1 wherein said molybdenum foil is of substantially rectangular configuration.

4. The improvement according to claim 2 wherein said foil is subjected to an etching operation subsequent to said sandblasting.

5. The improvement according to claim 2 wherein said rough surfaces of said opposed longitudinal sides occupy a depth of about one-tenth of the total thickness of said foil.

6. A method of making a molybdenum foil member for being entirely embedded within a glass press sealed end of a tungsten halogen lamp, said method comprising:

providing a molybdenum wire having a substantially circular cross-sectional configuration;

passing said molybdenum wire through a plurality of opposed roller members to provide said wire with a substantially rectangular, cross-sectional, flat configuration having opposed longitudinal sides;

substantially reducing the thickness of the cross-sectional end portions of said wire to provide a pair of opposed, outwardly extending, substantially tapered end segments and thereby define said foil member; and providing a rough surface within each of said opposed longitudinal sides of said foil member, said rough surfaces within said opposed longitudinal sides enabling said foil member to substantially adhere to said glass material of said press sealed end when said end is subjected to elevated temperatures, the expansion forces of said molybdenum foil having said tapered end segments and said rough surfaces within said longitudinal sides thereof being substantially evenly distributed within said molybdenum foil against said glass material during said elevated temperatures, thereby substantially preventing crack formation within said press sealed end.

7. The method according to claim 6 wherein said rough surfaces within said opposed longitudinal sides of said wire are provided by exposing said sides to a sandblasting operation.

8. The method according to claim 7 wherein said reducing of said thickness of said cross-sectional end portions of said wire is accomplished by chemical etching.

9. The method according to claim 8 wherein said chemical etching is performed subsequent to said sandblasting operation.

* * * * *